US006950525B2

(12) United States Patent
Harrell et al.

(10) Patent No.: US 6,950,525 B2
(45) Date of Patent: Sep. 27, 2005

(54) AUTOMATED SYSTEM AND METHOD FOR AUTOMOTIVE TIME-BASED AUDIO VERIFICATION

(75) Inventors: Michael R. Harrell, Woodhaven, MI (US); Glenn M. Thompson, Goodrich, MI (US); John D. Tompkins, Troy, MI (US)

(73) Assignee: General Motors Corporation, Detroit, MI (US)

( * ) Notice: Subject to any disclaimer, the term of this patent is extended or adjusted under 35 U.S.C. 154(b) by 720 days.

(21) Appl. No.: 09/975,609

(22) Filed: Oct. 12, 2001

(65) Prior Publication Data

US 2003/0073408 A1 Apr. 17, 2003

(51) Int. Cl.[7] ..... H04R 29/00
(52) U.S. Cl. ..... 381/59; 324/503; 381/86
(58) Field of Search ..... 381/86, 58, 59, 381/56, 122; 324/503; 455/226.1

(56) References Cited

U.S. PATENT DOCUMENTS 4,603,325 A 7/1986 Marino et al.
4,743,887 A 5/1988 Pothier
4,881,910 A * 11/1989 Odemer ..... 439/476.1
5,042,070 A 8/1991 Linna et al.
5,108,335 A 4/1992 Carey et al.
5,164,703 A 11/1992 Rickman
5,361,305 A 11/1994 Easley et al.
5,631,566 A 5/1997 Person et al.
5,940,518 A 8/1999 Augustyn et al.

* cited by examiner

*Primary Examiner*—Ping Lee
(74) *Attorney, Agent, or Firm*—Laura C. Hargitt

(57) ABSTRACT

A time-based audio verification system used to verify the correct installation of an audio system in a vehicle is based on the principle that the distances between a pick-up microphone and each speaker within the vehicle are different. Sound travels at a constant rate, and the wave is measured that provides the time it takes the sound emanating from each speaker to travel to the microphone. Once it is determined where in the wave each speaker is located, the presence of each speaker in the vehicle can be determined. Additionally, the level of each speaker in the curve can be analyzed to determine individual speaker output quality.

16 Claims, 11 Drawing Sheets

AUTOMATED SYSTEM AND METHOD FOR AUTOMOTIVE TIME-BASED AUDIO VERIFICATION

TECHNICAL FIELD

This invention relates generally to automotive audio testing. More particularly, the invention relates to an automated system and method for time-based audio verification as a way to determine the proper installation and functioning of an audio system in an automotive vehicle.

BACKGROUND OF THE INVENTION

Most automobiles manufactured and sold today are factory equipped with various types of audio sound systems. For example, it is common to have an AM/FM radio factory installed as standard equipment. Optional components may include a cassette player, a compact disc player, a television, a television/video cassette player combination, and digital video disc player/viewer. An essential component to these various systems are speakers.

Upon completion of the installation of the entire audio or audio/visual system, some form of an audio test is conducted to verify that the speakers are connected properly. Test conditions are limited and historically were limited to turning on the radio and listening to each speaker.

Later techniques coupled vehicle alignment with audio testing in order to better utilize plant floor space and reduce test variances. Reduction in manual testing was important to reduce costs. Additionally, testing in a noisy manufacturing environment was difficult.

One method, described in U.S. Pat. No. 5,361,305, is applicable to an audio system which is coupled to a vehicle data bus. The data bus is accessible for coupling to an external controller. The test system is fully automatic and uses the vehicle data bus commands to control the audio system and monitor its response to radio frequency test signals in the presence of high ambient noise. The test checks all speakers and associated harness for proper connection and function. The computer exercises audio control functions and monitors test results through a controlled radiation pattern modulated by an encoded test signal, which is used to provide an RF test signal in close proximity to the vehicle antenna base.

The test sequence includes exercising AM and FM Seek functions to find the generated RF signals, thereby ensuring the integrity of the cabling and antenna connections. Additionally, Fade and Balance settings are tested to select and positively identify each speaker individually, for example by zone, such as left front, left rear, right front and right rear. Additional speakers of significantly different frequency ranges can also be tested one at a time to verify proper connection within a zone. A sine wave or warble tone is output by the speakers which is then received by a microphone placed in the vehicle. The tone received by the microphone is processed by a digital signal processor, and a single decibel level is calculated independent of the number of speakers present. The calculated decibel level is compared to a predetermined pass/fail limit. When a failed test is determined, a fail code is generated and the vehicle is required to be repaired and a retest performed. The predetermined decibel level, however, does not indicate that all speakers in a zone are functioning. Similarly, the predetermined pass/fail limit cannot determine if the speakers are functioning properly.

However, as vehicle sound system complexity increases and the number of speakers increase, it becomes increasingly difficult to test for the presence of all the speakers and the quality of those speakers. For example, many vehicle speakers are now wired in parallel, making it impossible to isolate and verify each speaker individually. If one of the two speakers wired in parallel is defective, the sound volume will still indicate working speakers. Thus, there is a need to increase the speed of the testing and the ability to verify that all the speakers are connected, as well as the need to determine if the speakers are performing properly.

SUMMARY OF THE INVENTION

Accordingly, it is a primary object of the present invention to provide an audio verification system to determined the correct installation of a vehicle's audio system using time-based verification.

Another object of the invention is to determine the correct functioning of audio speakers in a vehicle using time-based verification.

Another object of the invention is to provide a method for determining the quality of each speaker in a vehicle using a time-based audio verification system.

The present invention is directed to a time-based audio verification system used to verify the correct installation of an audio system in a vehicle. Time-based audio verification provides an entire wave representing sound levels, in decibels, over time. Time-based audio verification is based on the principle that the distances between a pick-up microphone and each speaker within the vehicle are different. Sound travels at a constant rate, and the wave provides the time it takes the sound emanating from each speaker to travel to the microphone. Once it is determined where in the wave each speaker is located, the presence of each speaker in the vehicle can be determined. Additionally, the level of each speaker in the curve can be analyzed to determine individual speaker output quality.

A radio signal generator connected to a digital signal processor broadcasts a frequency sweep over time. The frequency range is, for example, approximately 200 Hz to approximately 18,000 Hz over a time period of approximately 1,000 milliseconds. With the radio turned on, the sweep can be received by the radio and rebroadcast through pre-selected speakers chosen using the radio fade/balance controls. A microphone placed within the vehicle picks up the speaker outputs and returns the signal to the digital signal processor. The digital signal processor compares the signal being input to the radio with the output of the speakers. Upon completion of the sweep, the digital signal processor or other computer generates a single wave, or energy time curve, that represents decibel levels over time. The waveform is then input to an audio verification program for analysis to determine whether the selected speakers are functioning and, optionally, whether the selected speaker are performing within predetermined parameters.

The audio verification program analyzes the energy time curve by first locating wave peaks, or spikes, that indicate the presence of a particular speaker under investigation. The key principle is that the distances between the microphone and each speaker is different. Sound traveling within the vehicle is at approximately constant rate; therefore, the time it takes for the speaker input signal to reach the microphone can be measured. Measuring the time it takes the sound to travel from each individual speaker allows multiple speakers to be measured during the same test. In this manner, by knowing where to look for the spike correlating to each speaker based on speaker and microphone location, speaker presence can be determined. Using this invention, speakers wired in parallel can be detected and operating status verified. Additionally, the corresponding decibel level of each spike can be analyzed to determine the output quality of the speaker. In a regular production line for a given automobile, the speaker locations and the type of speaker are limited and documented, and placement of the microphone at a predetermined location can result in speedy and consistent results.

Four decibel level limits are used to determine the playing quality of each speaker under test. The first level is a "no speaker playing" limit. If no peak is detected at the appropriate location on the curve, or the peak is below the first level, then the speaker fails the test for no detected sound. The second level is greater than the first level and lower than a third level, the third level indicating "speaker OK" lower limit. A spike measured below the second level indicates that the speaker level is too low, and the speaker fails for low sound level. The fourth level indicates the "speaker OK" upper limit. A spike measured between the third and fourth limits indicates that the speaker is performing nominally. A spike measured above the fourth limit indicates that the speaker level is too high, and the speaker fails for too high a sound level.

Use of the time-based audio verification system eliminates the guesswork of determining proper connection and operation of audio speakers. As a result, vehicle quality is increased. Additionally, warranty costs are decreased by the detection of poor performing or missing components prior to shipment of the vehicle. Eliminating the high incidence of incorrect audio component diagnosis reduces repair costs. Eliminating dependence upon an operator also reduces audio test verification cost. Additionally, improved audio product information can be given to suppliers. Finally, decreased facility support costs are reduced because of increased verification reliability and accuracy.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following figures, wherein.

Throughout the drawing figures, like reference numerals will be understood to refer to like parts and components.

DESCRIPTION OF THE PREFERRED EMBODIMENT

Figure 1:
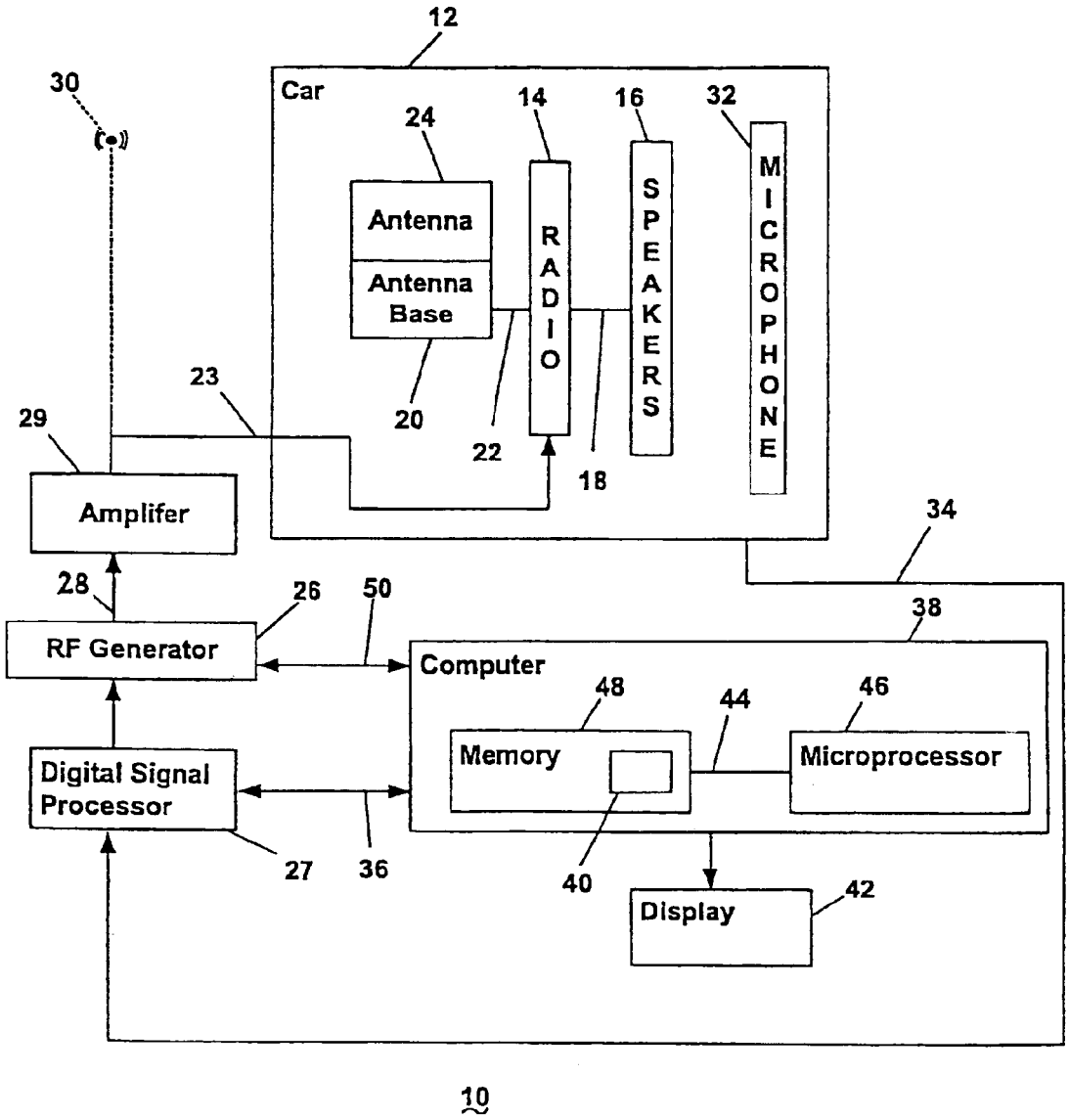
FIG. 1 is a block diagram of a system for testing the audio components of a vehicle.

FIG. 1 is a block diagram of a system 10 for testing the audio components of a vehicle 12. FIG. 1 depicts a vehicle 12 having an audio generating component 14 coupled to a speaker 16 by way of a harness 18. The audio generating component 14 can be any audio generating electronic device commonly found in vehicles 12, including, for example, AM/FM radios, compact disc players, audio cassette players, digital audio tape players, radio receivers or transceivers that receive at any frequency assigned for police or fire departments, cellular telephones, satellite radios, or any other radio device or electronic storage media player that can generate an audio signal for use by speakers 16. When the audio generating component 14 is an AM/FM radio or other radio receiving device, an antenna base 20 is also connected to the audio generating component 14 by a cable 22. During testing, an antenna 24 may be installed on the antenna base 20.

The audio test system 10 has an RF generator 26 that produces a radio signal 28 that is transmitted to a transmitting antenna 30 located near the antenna base 20. Alternatively, the radio signal 28 is transmitted to a coupler that is connected directly to the antenna base 20. In the preferred embodiment, radio signal 28 is transmitted directly to a receive end of a test cable 23 that is connected at an output end to the audio generating component 14. The RF generator 26 is capable of generating a frequency sweep, for example, from approximately 200 Hz to approximately 18,000 Hz, over a predetermined period of time, for example, approximately 1,000 msecs. The frequency sweep generated by the digital signal processor 27 is carried by a carrier wave generated by the RF generator 26.

In the preferred embodiment, the digital signal processor generates a plus/minus 24 KHz frequencies. The RF generator 26 is external, allowing the user to select a radio broadcast carrier frequency and to help boost the output signal. The computer controls the external RF generator 26, indicating which carrier frequency to use, which channel to use, for example left or right channel, and the like. An optional amplifier 29 may be located after the output of the RF generator 26.

The radio signal 28 is received by the antenna 24 or the antenna base 20, where it is input to the audio generating component 14 and broadcast to speaker 16. It will be understood that speaker 16 can be any number of speakers connected to the audio generating component 14. Typically, the number of speakers 16 is limited by the size of the vehicle 12, the size of the speakers, the available power, and the quality of the speakers. In general, the total number of speakers 16 contained in vehicle 12 is from 1 to 40, and more typically between 2 and 12 speakers. Specific speakers 16 to be tested may be selected using fade and balance features of the audio generating component 14, which determines front or rear speakers 16 and left or right speaker 16, respectively. Other speaker selection features, for example, top or bottom, base or treble or midrange, and the like, may also be available to selected individual speakers to test.

A microphone 32 is positioned inside the vehicle 12 and receives output, or broadcast from speaker 16. Output signal 34 from the microphone 32 is input to the digital signal processor 27. In this manner, the digital signal processor 27 compares the broadcast radio signal 28 to the received signal 34. Upon completion of the frequency sweep that is broadcast 28, the digital signal processor 27 processes the information and assembles a single wave, known as a waveform 36, that represents decibel levels over time, and outputs this waveform 36 to a computer 38 for further analysis by an audio analysis program 40. The audio analysis program 40 determines whether the speakers 16 are working and within predetermined specifications.

The computer 38 is connected to a display device 42. The display device 42 may be a CRT monitor, an LCD monitor, a projector and screen, a printer, or any other device that allows a user to visually observe images.

The computer 38 also contains a bus 44 connecting a processor 46 and a memory 48.

The processor 46 is preferably implemented on a general purpose computer. However, the processor 46 can also be implemented on a special purpose computer, a programmed microprocessor or microcontroller and peripheral integrated circuit elements, an ASIC or other integrated circuit, a digital signal processor, a hard wired electronic or logic circuit such as a discrete element circuit, a programmable logic device such as a PLD, PLA, FPGA or PAL, or the like. In general, any device, capable of implementing a finite state machine that is in turn capable of implementing the flow charts shown in FIGS. 7–13, can be used to implement a processor 46.

The memory 48 is preferably implemented using static or dynamic RAM. However, the memory 48 can also be implemented using one or more of static RAM, dynamic RAM, ROM, flash memory, hard disk drive, CD-ROM drive, Floppy Disk Drive, Network Servers or the like.

The memory 48 stores the audio analysis program 40. The audio analysis program 40 can be any program capable of implementing the flow charts shown in FIGS. 7–13. The program 40 can be written in any language compatible with the processor 46.

Upon determination that a test is to be performed, the computer 38, using the audio analysis program 40, generates an output 50 that, when received by the RF generator, indicates what frequency and modulation are to sent to the vehicle 12 for audio testing.

Figure 2:
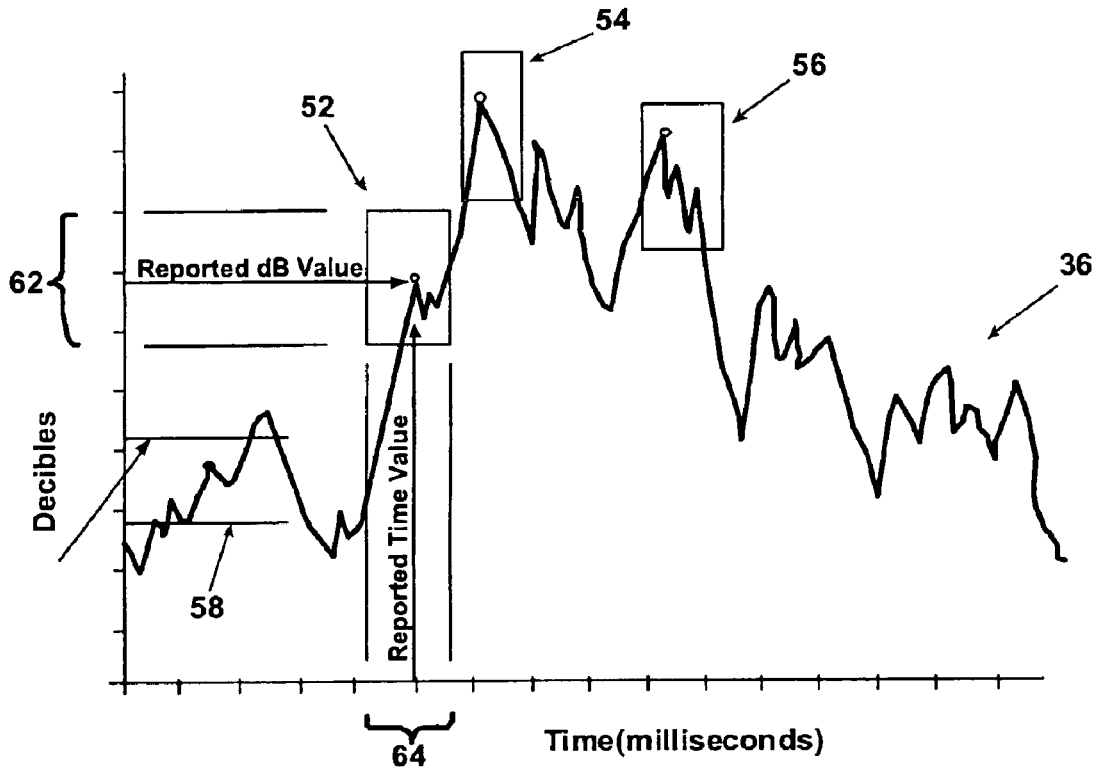
FIG. 2 depicts a sample waveform indicative of the presence, or absence, of a speaker within the vehicle.

FIG. 2 shows a sample waveform or energy time curve 36. The audio analysis program analyzes the waveform by locating key peaks, or wave spikes, which are indicative of the presence, or absence, of a speaker 16 within the vehicle quadrant. The distance between the microphone 32 and each speaker 16 are different, and since sound travels at a relative constant rate within the vehicle 12, the wave provides the time it took the sound to travel from the speaker 16 to the microphone 32. The distance from the microphone 32 to the speaker 16 can be calculated a distance=velocity*time. For any vehicle with an audio system, a set-up test is performed in order to generate a waveform for each speaker 16 with the microphone 32 at or near the same position within the vehicle. Using this data, a user, or audio analysis program 40, can know where on the waveform 50 to look for a spike that is indicative of a particular speaker 16. Since the microphone 32 is placed in the vehicle 12 such that all the speakers are at different distances from the microphone, the presence of several speakers can be determined using a single waveform 50.

Speaker test zones define the time and decibel search boundaries of the waveform 50 for a particular speaker 16. In the preferred embodiment, three speaker test zones are used: the tweeter test zone 52, the midrange test zone 54, and the bass test zone 56. The ambient noise level 58 is a calculated value. The program locates the largest peak within each zone 52, 54, 56 and reports the decibel and time values. Each zone 52, 54, 56 has an allowable decibel deviation 62 and an allowable time deviation 64.

Figure 3:
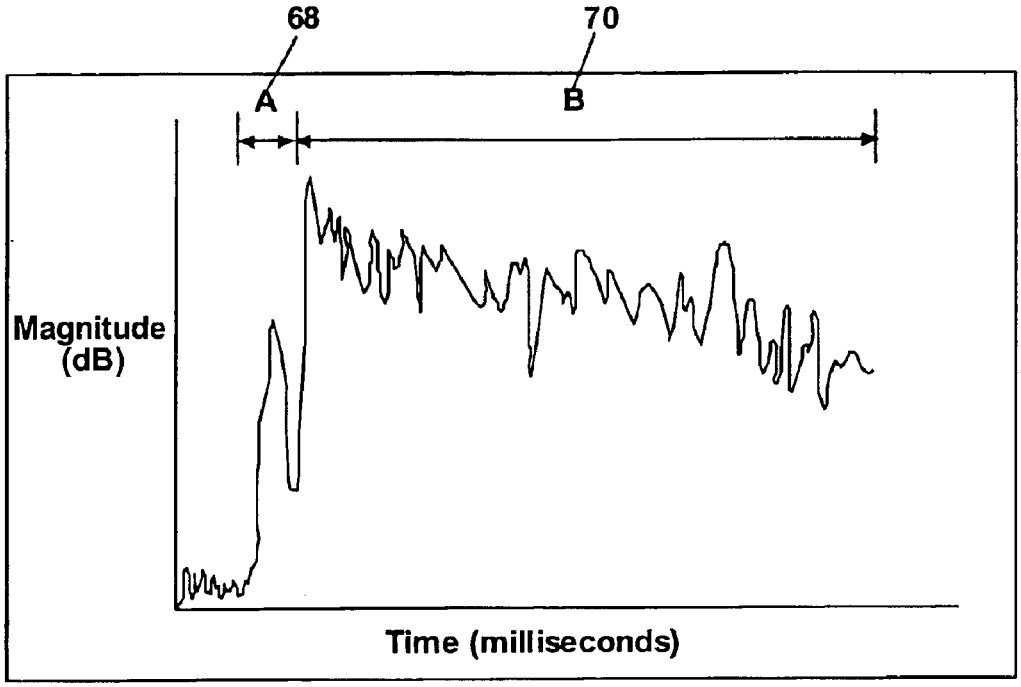
FIG. 3 depicts a sample waveform of a front-left quadrant tweeter and midrange speakers.
Figure 4:
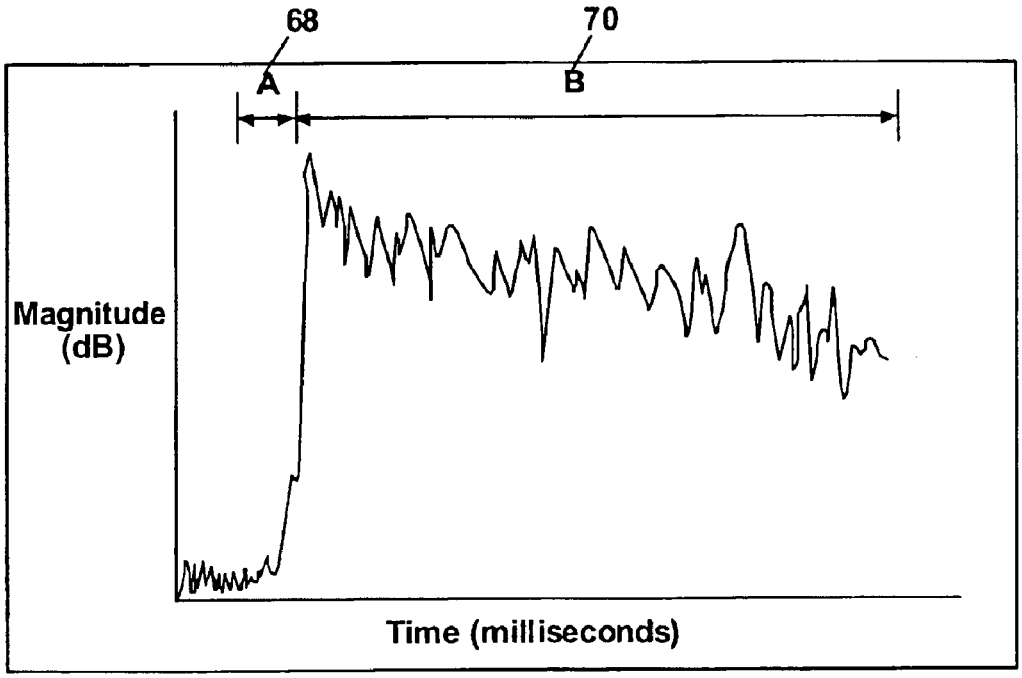
FIG. 4 depicts a sample graphical impulse response of a frontleft quadrant midrange speaker.
Figure 5:
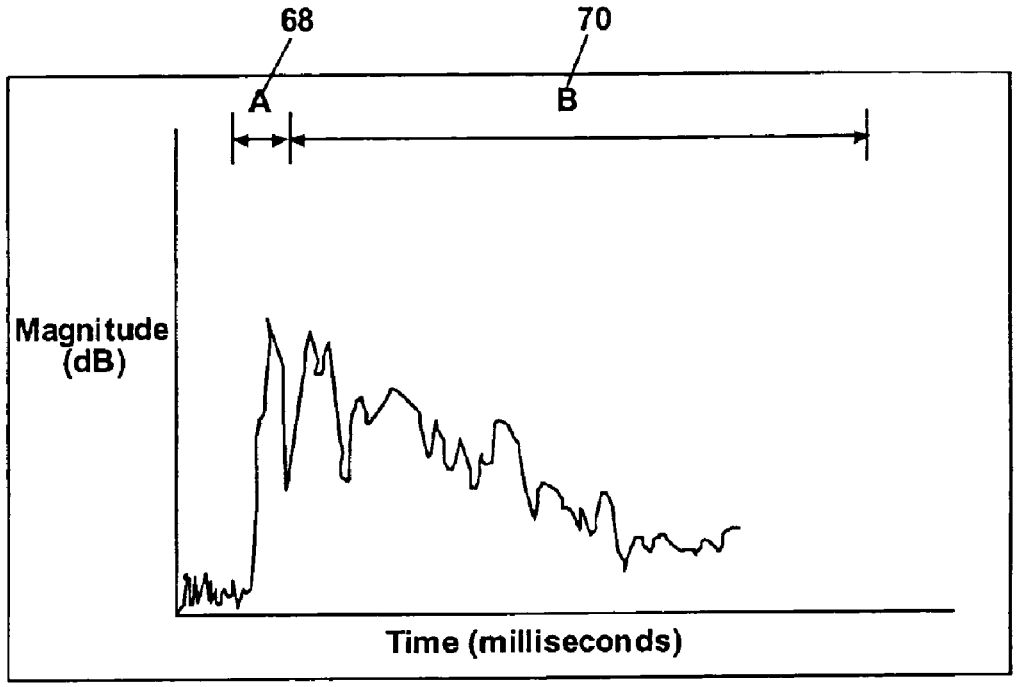
FIG. 5 depicts a sample graphical impulse response of a frontleft quadrant tweeter speaker.
Figure 6:
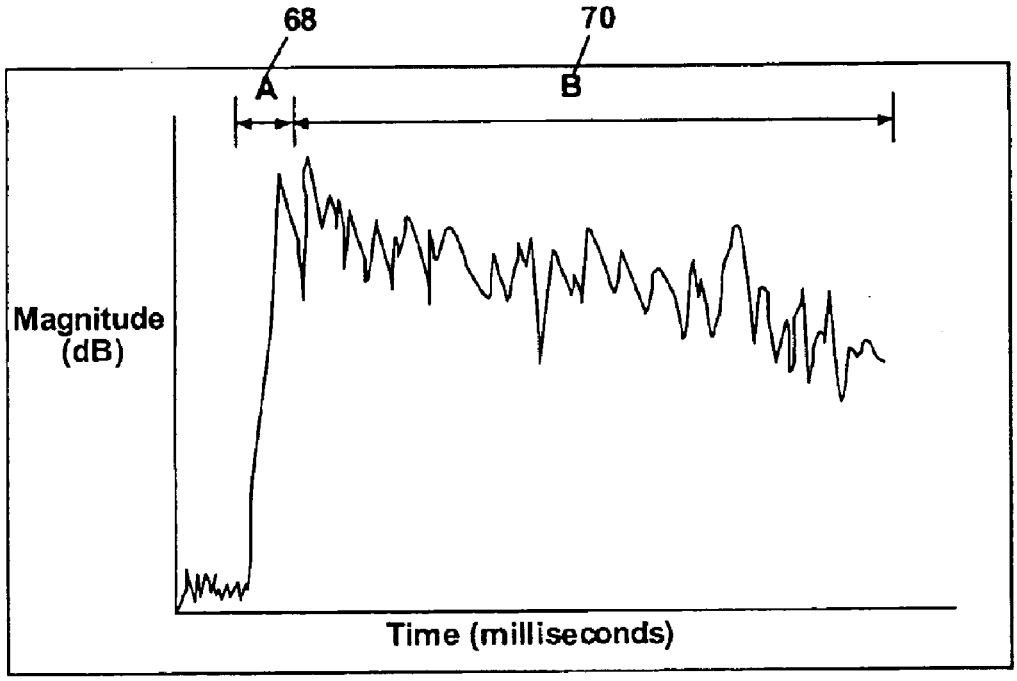
FIG. 6 depicts a sample waveform of a front-left quadrant tweeter and midrange speakers with a shorted capacitor on the tweeter.
Figure 7:
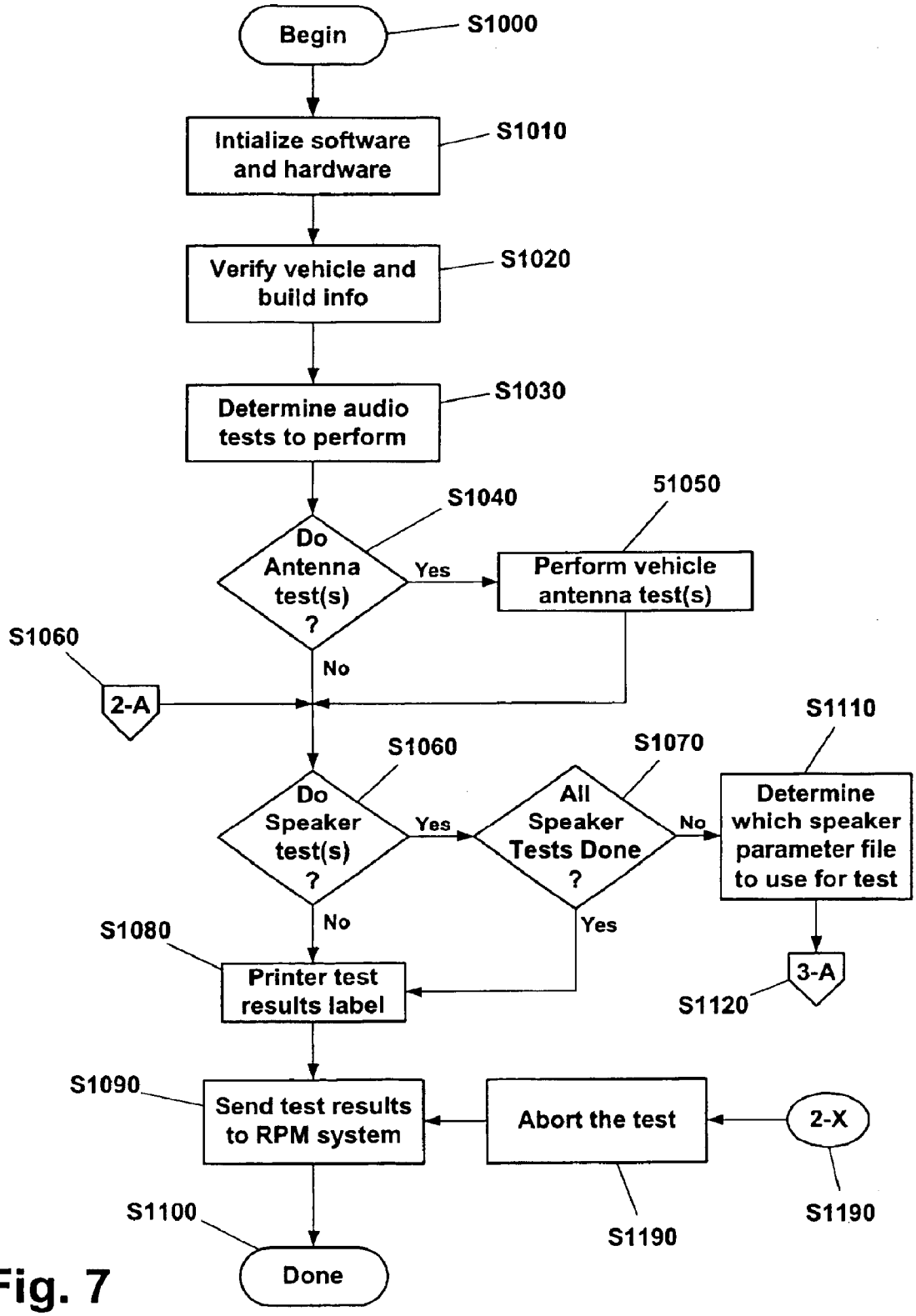
FIGS. 7–13 depict flow charts outlining the audio analysis program of the invention.
Figure 8:
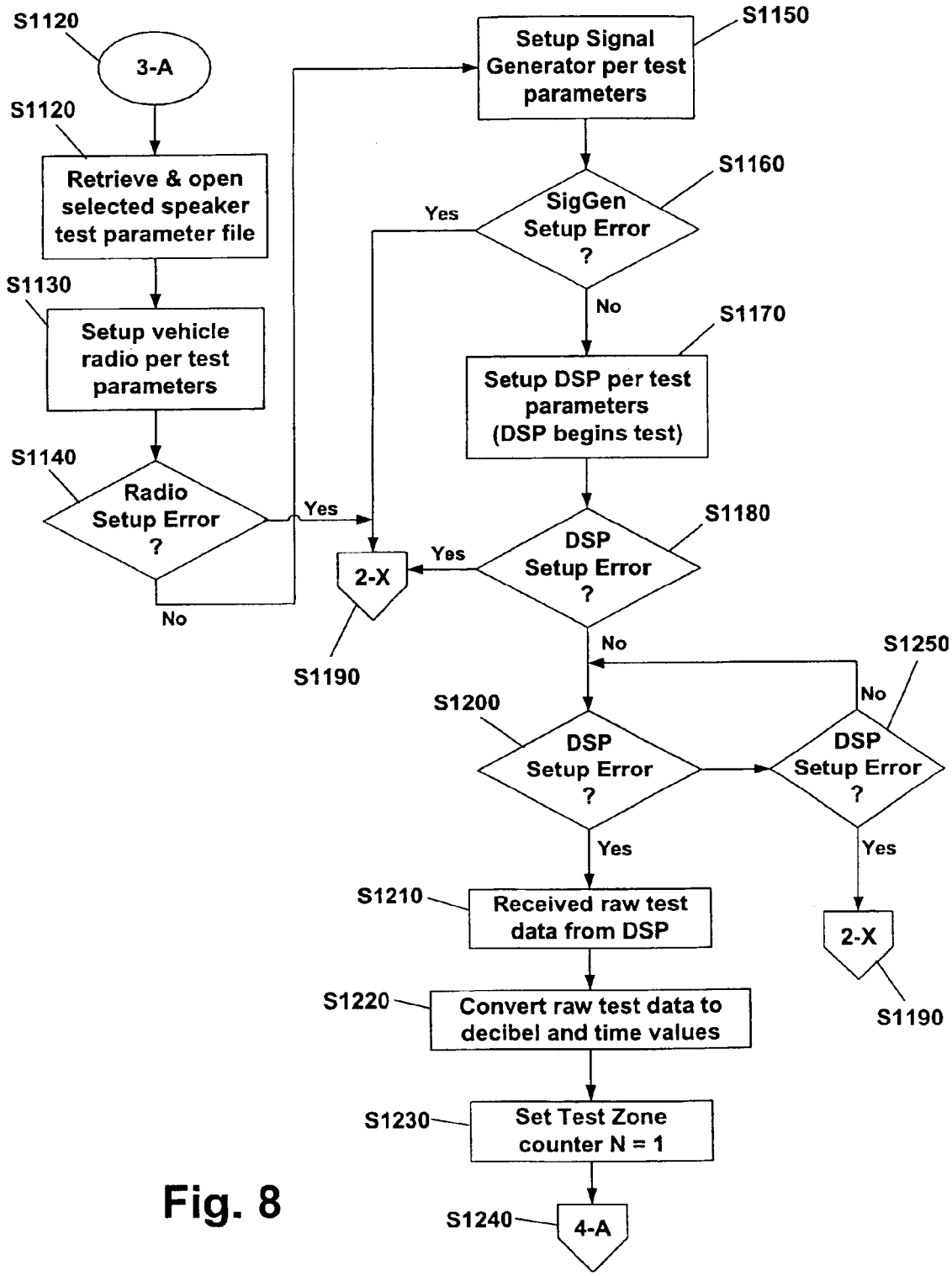
Figure 9:
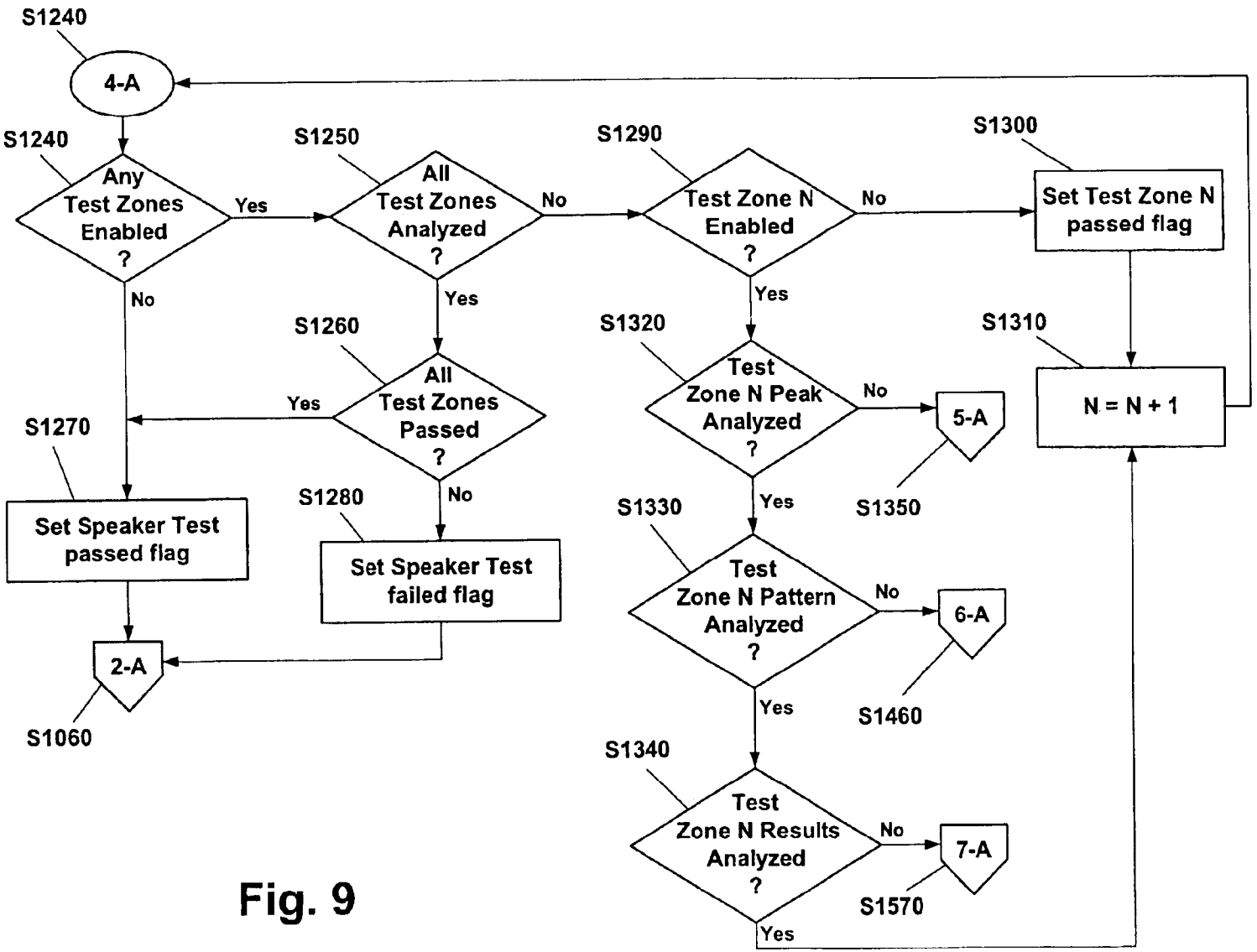
Figure 10:
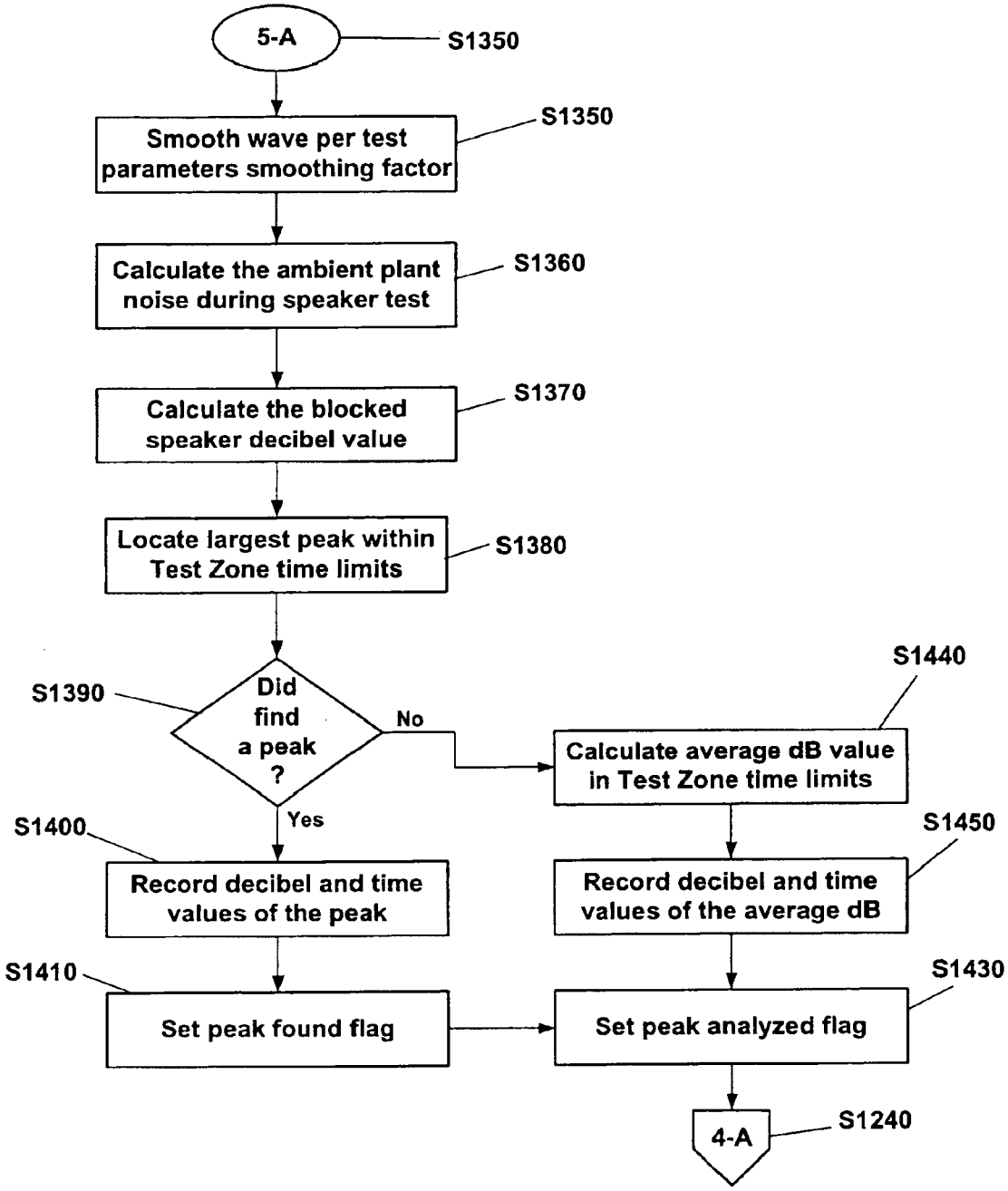
Figure 11:
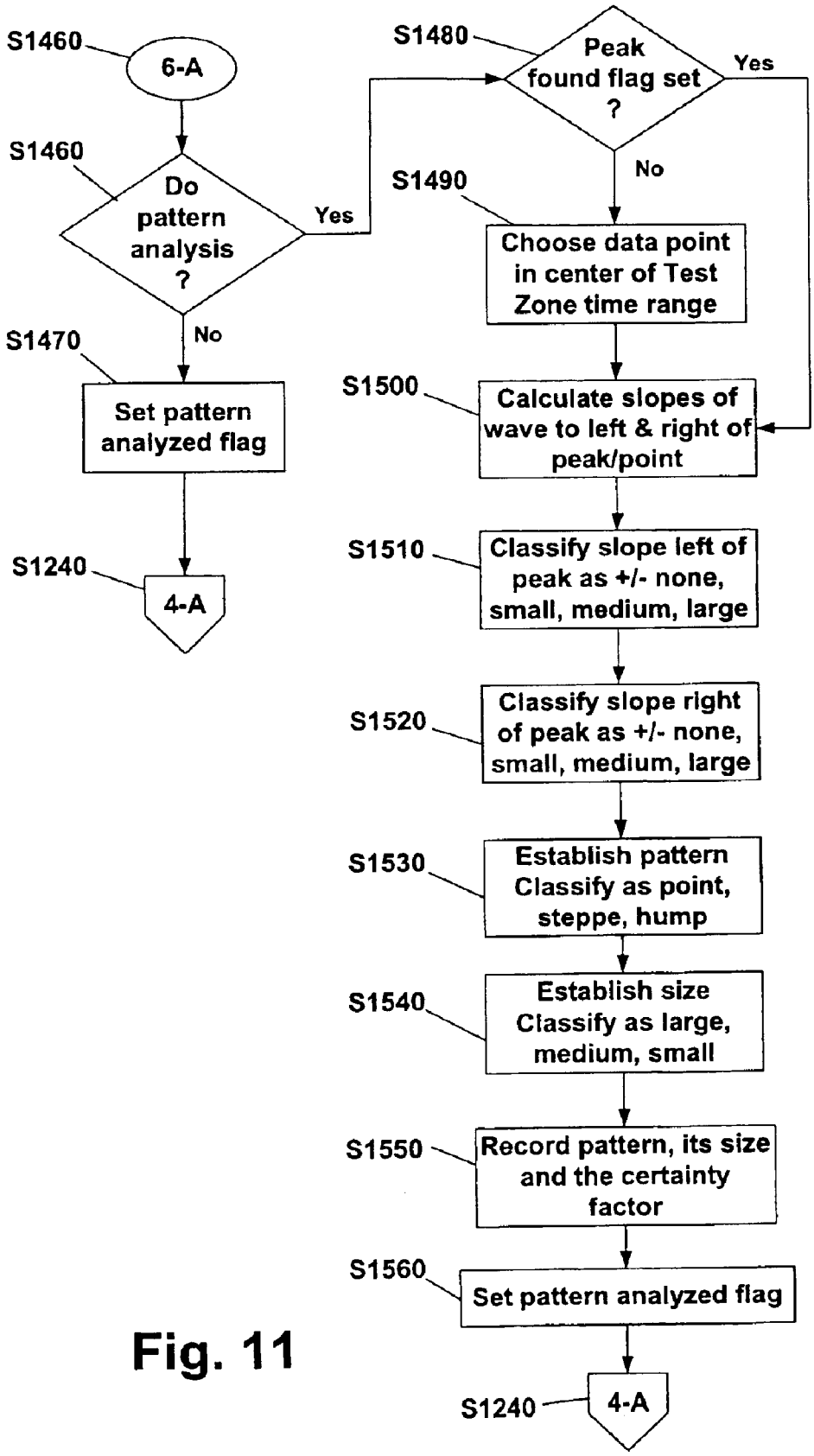
Figure 12:
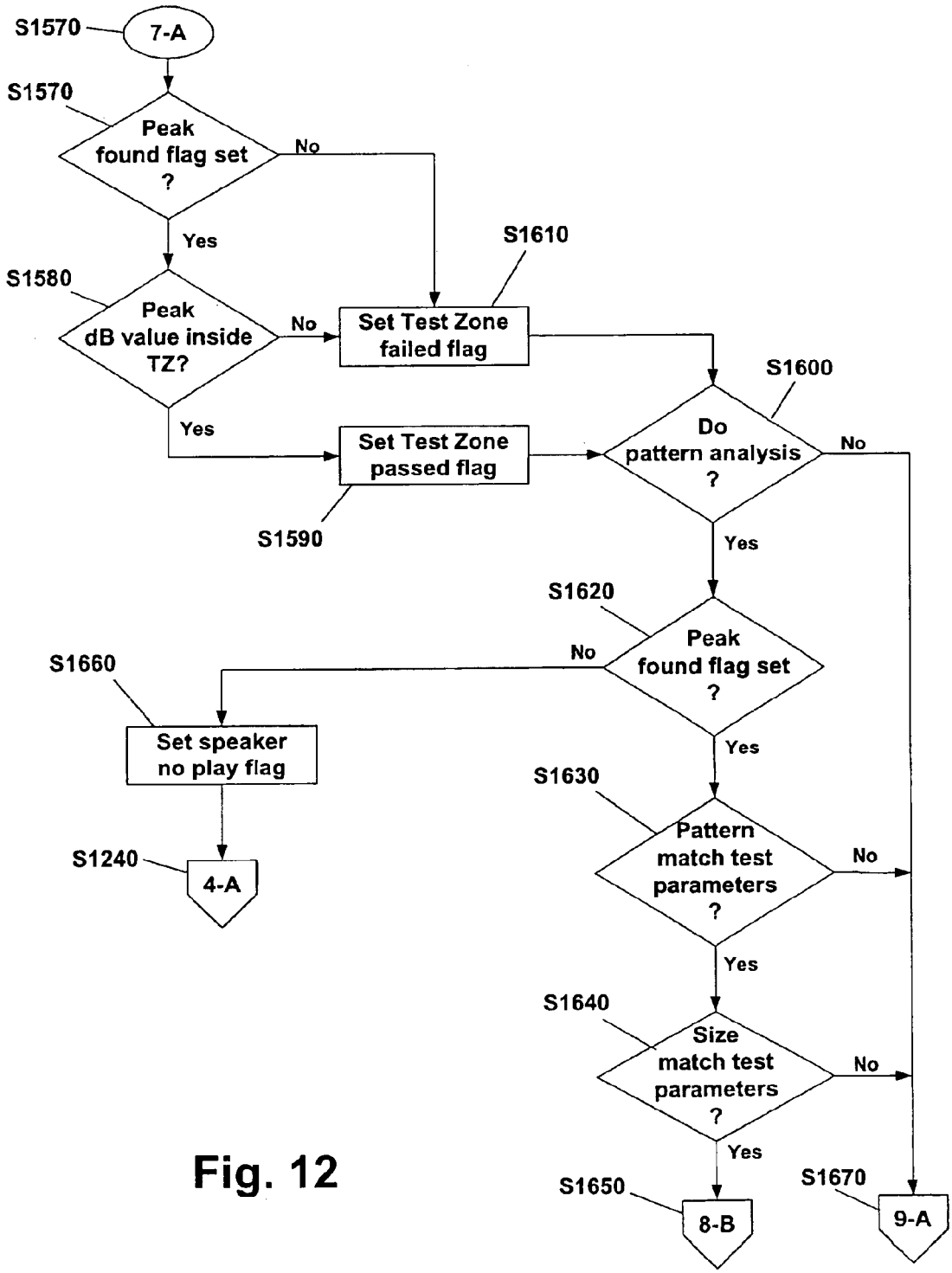
Figure 13:
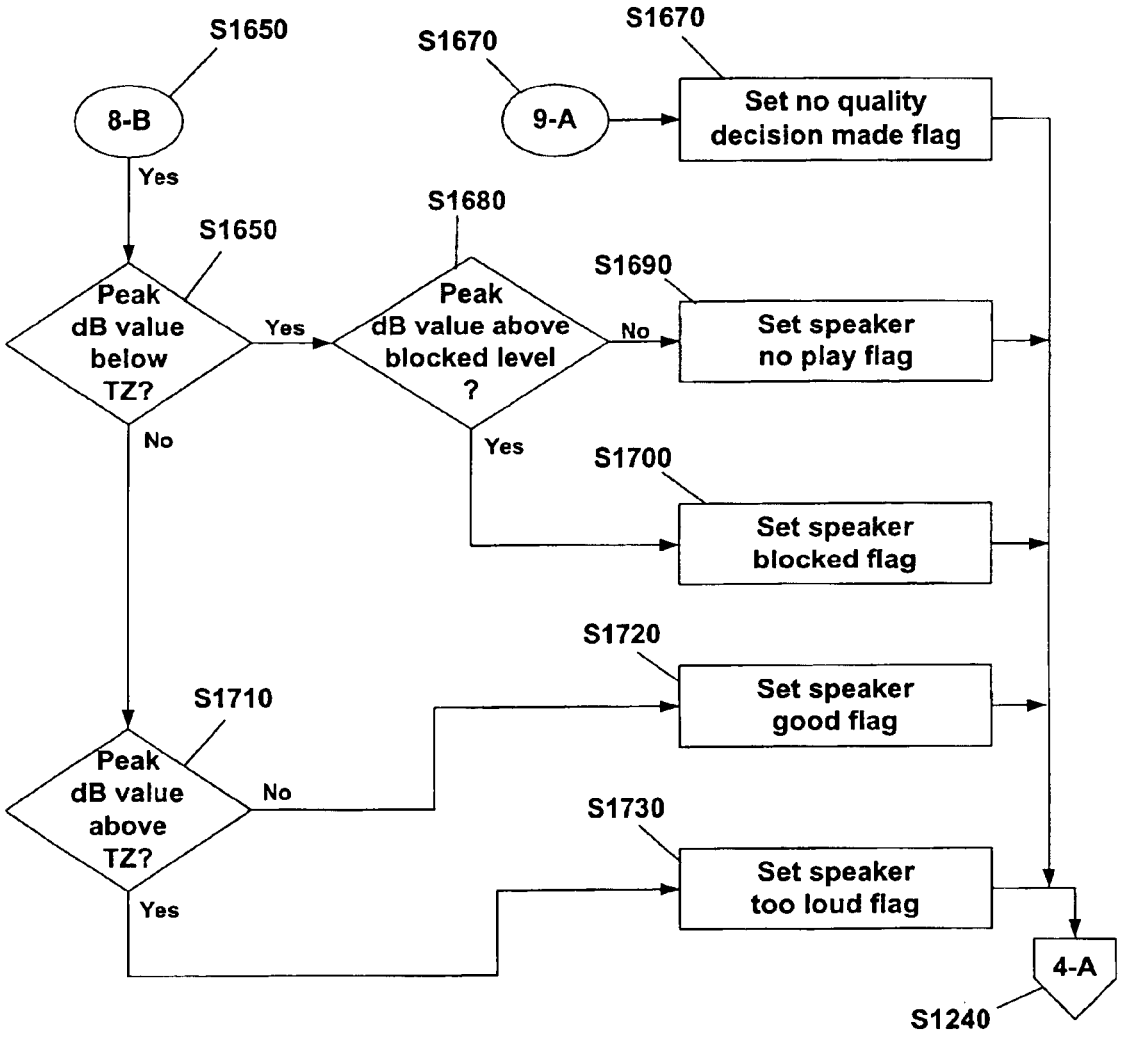

FIGS. 3–6 depict representative graphs of the response of speakers in a vehicle. The two speakers tested were the front-left quadrant tweeter and midrange. In FIG. 3, both the tweeter 68 and the midrange 70 are playing. FIG. 4 shows the graphical impulse response when the tweeter 68 is disconnected. FIG. 5 shows the response when the midrange 70 is disconnected. FIG. 6 shows the response when a shorted capacitor is used as a high pass filter on the tweeter 68. It can be seen from FIGS. 3–6 that when either speaker 68, 70 is not playing or the response is incorrect, the nonfunctioning or malfunctioning speaker can be detected.

FIGS. 7–13 outline one preferred method for testing the presence and performance of speakers 16 in a vehicle 12 according to this invention. The method begins in step S1000 and continues to step S1010. In step S1010, the software and hardware are initialized, and continues to step S1020. In step S1020, vehicle and build information are verified in order to determine what type of vehicle is to be tested and to identify what audio equipment is expected to be present, and continues to step S1030. In step S1030, a determination is made of the audio test to be performed, and continues to step S1040. In step S1040, the program determines if an antenna test is to be performed. If an antenna is present and the test is to be performed, the process continues to step S1050 and the antenna test is performed, and continues to step S1060. In an antenna test is not to be performed, the process continues to step S1060. In step S1060, a program determines if a speaker test is to be performed, and if not, continues to step S1080. In step S1080–S1090, the test results are printed and output, and the test is completed at step S1100.

If a speaker test is to be performed, in step S1070 a determination is made whether all the speaker tests are complete. In step S1070, if all speaker tests are completed, the process continues to step S1080. If all the speaker tests are not complete at step S1070, then a determination is made in step S1110 which speaker parameter file to use for the test, and continues to step S1120.

In step S1120, the selected speaker test parameter file is retrieved and opened. Next, in step S1130, vehicle radio setup is performed according to the retrieved parameters, and continues to step S1140. In step S1140, if a radio setup error occurs, the test is aborted at step S1190. If no radio setup error is detected in step S1140, the signal generator is set up in step S1150, and continues to step S1160. In step S1160, if a signal generator setup error occurs, the test is aborted at step S1190. If no signal generator set-up is detected in step S1160, the digital signal processor is set up in step S1170, and continues to step S1180. In step S1180, if a digital signal processor setup error occurs, the test is aborted at step S1190. If no digital signal processor error is detected in step S1180, the test continues to step S1200.

In step S1200, it is determined whether the digital signal processor has output a completed signal. If a completed signal is not detected in step S1200, it is determined in step S1250 whether the digital signal processor has timed out in step S1250. If the digital signal processor has not timed out in step S1250, the test continues at step S1200. If the digital signal processor timed out at step S1250, the test is aborted at step S1190.

When the digital signal processor has output a completed signal at step S1200, the raw test data is output to the computer in step S1210, and continues to step S1220. In step S1220, the raw test data is converted to decibel and time values, and continues to step S1230. In step S1230, the test zone counter is set to N=1, and the test continues to step S1240.

Next, in step S1240, it is determined whether any test zones are enabled. As stated previously, a test zone indicates that portion of the measured waveform to be observed for speaker presence and/or performance. If there are test zones enabled, the process continues to step S1250. In step S1250, it is determined whether all the test zones have been analyzed. If all the test zones have been analyzed, the test continues at step S1260. In step S1260, it is determined if all the test zones passed. If all the zones passed, a speaker test passed flag is set at step S1270, and continues to step S1060. If all the zones did not pass in step S1260, a speaker failed flag is set at step S1280, and the process continues to step S1060. If in step S1240 no test zones are enabled, a speaker test passed flag is set at step S1270, and continues to step S1060.

If in step S1250 not all the test zones were analyzed, the process continues to step S1290. In step S1290, it is determined whether test zone N is enabled. If test zone N is not enabled, a test zone N passed flag is set at step S1300, and continues to step S1310. In step S1310, the counter N is updated to N+1.

If in step S1290 test zone N is enabled, it is next determined in step S1320 whether zone N peak was analyzed. If test zone N peak was analyzed in step S1320, it is determined at step S1330 whether the test zone N pattern was analyzed. If the test zone N pattern was analyzed in step S1330, a determination is made in step S1340 whether test zone N results were analyzed. If the test zone N results were analyzed in step S1240, then the process continues to step S1310, where the counter N is updated to N+1.

If test zone N peak was not analyzed in step S1320, the process continues to step S1350. In step S1350, the waveform is smoothed according to a predetermined test parameters smoothing factor. Next, in step S1360, the ambient noise when the speaker was tested is calculated, and the blocked speaker decibel value is calculated in step S1370. Next, in step S1380, the largest peak within test zone time limits is determined, and continues at step S1390. In step S1390, it is determined whether a peak was found. If a peak was found in step S1390, the decibel and time values of the peak are recorded in step S1400. Next, the peak found flag is set in step S1410, and the peak analyzed flag is set in step S1430. The process then returns to step S1240.

If a peak was not found in step S1390, the average dB value in the test zone time limits is calculated in step S1440. Next, the decibel and time values of the average dB are recorded in step S1450, and the peak analyzed flag is set in step S1430. The process then returns to step S1240.

If the test zone N pattern was not analyzed in step S1330, the process continues to step S1460. In step S1460, it is determined whether a pattern analysis is to be performed. If no pattern analysis is performed in step S1460, the pattern analyzed flag is set in step S1470, and the process returns to step S1240.

If a pattern analysis is to be performed in step S1460, it is determined in step S1480 whether a peak was found and a flag should be set. If a peak was not found and the peak found flag is not set in step S1480, then the data point in the center of the test zone time range is selected in step S1490, and continues to step S1500. If a peak was found and the peak found flag was set in step S1480, the process continues to step S1500.

In step S1500, the slopes of the wave to the left and the right of the peak point are calculated. Next, in step S1510, the slope left of the peak is classified as +/− none, small, medium or large, and continues to step S1520. In step S1520, the slope right of the peak is classified as +/− none, small, medium or large, and continues to step S1530. In step S1530, a pattern is established for the test zone data and classified as point, steppe or hump, and continues to step S1540. In step S1540, a size is established for the test zone data, and classified as large, medium or small. Next, at step S1550, the pattern and size are recorded and the certainty factor is determined, and continues to step S1560. In step S1560, a pattern analyzed flag is set, and the process returns to step S1240.

If the test zone N results were not analyzed in step S1340, the process continues to step S1570. In step S1570, it is determined whether a peak was found and a peak found flag is to be set. If a peak found flag is set in step S1570, then in step S1580 it is determined whether the peak dB value is inside the test zone. In step S1580, if the peak dB value is inside the test zone, the test zone passed flag is set in step S1590, and continues to step S1600.

If no peak found flag was set in step S1570, or no peak dB value was found inside the test zone in step S1580, a test zone failed flag is set at step S1610, and continue to step S1600.

In step S1600, it is determined whether to perform a pattern analysis. If a pattern analysis is to be performed, it is determined at step S1620 whether a peak found flag was set. If a peak found flag was set in step S1620, it is determined in step S11630 whether the pattern matches the test parameters. If the pattern matched the test parameter, it is determined in step S1640 whether the size matched the test parameters. If the size matched the test parameters in step S1640, the process continues to stop S1650.

If the peak found flag was not set at step S1620, the speaker no play flag is set at step S1660, and the process returns to step S1240.

If no pattern analysis is performed at step S1600, or the pattern did not match the test parameters in step S1630, or the size did not match the test parameters in step S1640, the process continues to step S1670.

In step S1650, it is determined whether the peak dB value is below the predetermined test zone. If the peak dB value is below the predetermined test zone, the process continues to step S1680. In step S1680, it is determined whether the peak dB value is above a predetermined block level. If the peak dB value is not above a predetermined block level, at step S1690 a speaker no play flag is set, and the process returns to step S1240. If the peak dB value is above a predetermined block level in step S1680, at step S1700 a speaker blocked flag is set, and the process returns to step S1240.

If in step S1650 it is determined that the peak dB value is not below the test zone value, the process continues to step S1710. In step S1710, it is determined whether the peak dB value is above the test zone value. If the peak dB value is not above the test zone value, a speaker good flag is set at step S1720, and the process returns to step S1240. If the peak dB value is above the test zone value, a speaker too loud flag is set at step S1730, and the process returns to step S1240.

While advantageous embodiments have been chosen to illustrate the invention, it will be understood by those skilled in the art that various changes and modifications can be made therein without departing from the scope of the invention, as defined in the appended claims. For example, the actual location and type of microphone can vary, as well as the type and quantity of audio speakers tested. Placement of the audio speakers within the vehicle compartment can vary by design without affecting the ability of the invention to determine the functionality and performance of the speakers. The connections of the speakers to the audio generating component can vary, and can be any speaker cable known in the art of speaker cables, and is not limited to copper wires or shielded coaxial cables.

What is claimed is:

1. A system that determines the presence of an audio speaker connected to an audio generating component that can receive radio signals in a vehicle, the system comprising:

a computer having a memory and a microprocessor;

a display connected to the computer;

a signal processor that outputs a frequency sweep in response to a request from the computer;

a radio frequency generator that is controlled by the computer, whereby said radio frequency generator receives operating instructions from the computer and receives the frequency sweep from the signal processor an outputs an audio broadcast signal;

at least two audio speakers; and a cable that receives the audio broadcast signal at a receive end and carries the audio broadcast signal to an output end, said output end removably connected to the audio generating component, whereby the audio generating component receives the audio broadcast signal from the output end of the cable and outputs the received signal to the at least two audio speakers and wherein each of the at least two audio speakers outputs the received signal and collectively emits at least two concurrent audio signals, respectively;

a microphone placed in the vehicle and connected to the signal processor that detects the emitted audio signals, said signal processor processes the audio broadcast signal and the emitted audio signals and outputs a waveform to the computer; and a program stored in the memory that analyzes the waveform from the signal processor and determines the presence of a speaker according to predetermined rules.

2. The system of claim 1, wherein the signal processor is a digital signal processor.

3. The system of claim 1, wherein the cable output end is removably connected to a transmitting antenna and the audio broadcast signal is received at the transmitting antenna, and a receive antenna receives the audio broadcast signal from the transmitting antenna, the receive antenna coupled to the audio generating component.

4. The system of claim 1, wherein the audio generating component is one of an AM radio, an FM radio, and AM/FM radio, a satellite radio receiver, a compact disc player, a cassette tape player, a digital audio tape player, a cellular telephone transceiver, a compact disc player/recorder, a cassette tape player/recorder, a digital audio tape player/recorder, a television, a video cassette player, a ham radio receiver or transceiver, and a digital video disc player.

5. The system of claim 1, wherein the signal is modulated.

6. The system of claim 1, wherein the program can detect the presence of more than one speaker.

7. The system of claim 1, wherein the program can determine proper speaker operation.

8. A method for determining the presence of an audio speaker in a vehicle having an audio speaker connected to an audio generating component that can receive radio signals, the method comprising the steps of:

placing a microphone in the vehicle;

transmitting a computer-controlled radio signal to the vehicle;

receiving the radio signal at the audio generating component;

converting the radio signal to an audio signal;

outputting the audio signal to at least two speakers;

outputting the audio signal from the at least two speakers concurrently;

detecting the audio signal from the at least two speakers at the microphone; and analyzing the detected signal for speaker presence.

9. The method of claim 8, wherein analyzing said detected signal includes determining an operable connection to the at least two speakers.

10. The method of claim 8, wherein transmitting comprises transmitting a predetermined modulated signal.

11. The method of claim 8, wherein the detected signal is compared to the transmitted signal and a resulting waveform is analyzed for speaker presence and speaker performance.

12. A The method of claim 11, wherein the speaker performance is one of not present, present and performing below a first predetermined value or range, present and performing at a predetermined nominal value or range, and present and performing above a second predetermined value or range.

13. A method for determining the performance level of an audio speaker in a vehicle having an audio speaker connected to an audio generating component that can receive audio broadcast signals, the method comprising the steps of:

placing a microphone in the vehicle; transmitting a computer-controlled radio signal to the vehicle;

receiving the audio broadcast signal at the audio generating component;

converting the audio broadcast signal to an audio signal; outputting the audio signal to at least two speakers;

outputting the audio signal from the at least two speakers concurrently and defining a concurrent audio output;

detecting the concurrent audio output at the microphone and generating a microphone output signal;

inputting the microphone output signal and the radio broadcast signal into a digital signal processor;

producing a single waveform that represents the concurrent audio output; and analyzing the single waveform for at least one of speaker presence and speaker performance.

14. The method of claim 13, wherein transmitting comprises transmitting a predetermined modulated signal.

15. The method of claim 13, further comprising comparing the microphone output signal to the transmitted signal.

16. The method of claim 13, wherein the speaker performance is one of not present, present and performing below a first predetermined value or range, present and performing at a predetermined nominal value or range, and present and performing above a second predetermined value or range.

* * * * *